US005567507A

United States Patent [19]

Paff et al.

[11] Patent Number: 5,567,507

[45] Date of Patent: Oct. 22, 1996

[54] INK-RECEPTIVE SHEET

[75] Inventors: Armin J. Paff; Alan G. Miller; Donald J. Williams, all of Austin, Tex.

[73] Assignee: Minnesota Mining And Manufacturing Company, St. Paul, Minn.

[21] Appl. No.: 396,000

[22] Filed: Feb. 28, 1995

[51] Int. Cl.[6] ..... B41M 5/00

[52] U.S. Cl. ..... 428/213; 428/195; 428/206; 428/216; 428/325; 428/326; 428/327; 428/331; 428/500

[58] Field of Search ..... 428/195, 500, 428/532, 534, 212, 422, 211, 213, 206, 215, 216, 325–327, 331

[56] References Cited

U.S. PATENT DOCUMENTS

| | | | |
|---|---|---|---|
| 4,636,805 | 1/1987 | Toganoh et al. | 346/1.1 |
| 4,701,836 | 10/1987 | Sakaki et al. | 346/135.1 |
| 4,935,307 | 6/1990 | Iqbal et al. | 428/500 |
| 5,027,131 | 6/1991 | Hasegawa et al. | 428/327 |
| 5,068,140 | 11/1991 | Malhotra et al. | 428/216 |
| 5,118,570 | 6/1992 | Malhotra | 428/474.4 |
| 5,120,601 | 6/1992 | Kotaki et al. | 428/327 |
| 5,134,198 | 7/1992 | Stofko, Jr. et al. | 525/205 |
| 5,192,617 | 3/1993 | Stofko, Jr. et al. | 428/411.1 |
| 5,206,071 | 4/1993 | Atherton et al. | 428/195 |
| 5,219,928 | 6/1993 | Stofko, Jr. et al. | 525/57 |
| 5,241,006 | 8/1993 | Iqbal et al. | 525/196 |
| 5,277,965 | 1/1994 | Malhotra | 428/216 |
| 5,342,688 | 8/1994 | Kitchin et al. | 428/402 |

FOREIGN PATENT DOCUMENTS

WO88/06532 9/1988 WIPO .

*Primary Examiner*—Pamela R. Schwartz
*Attorney, Agent, or Firm*—Gary L. Griswold; Walter N. Kirn; Darla P. Neaveill

[57] ABSTRACT

An ink-receptive sheet comprising a substrate bearing on at least one major surface an ink-receptive coating comprising at least two layers, a thin upper layer and a thick base layer, wherein said upper layer comprises a high viscosity binder selected from the group consisting of methylcellulose, hydroxypropyl methylcellulose, and blends thereof.

14 Claims, No Drawings

INK-RECEPTIVE SHEET

BACKGROUND OF THE INVENTION

The invention relates to transparent materials useful as receptive sheets for imaging, and more particularly, to improved ink-receptive layers therefor having improved image quality.

DESCRIPTION OF RELATED ART

Imaging devices such as ink jet printers and pen plotters are well known methods for printing various information including labels and multi-colored graphics. Presentation of such information has created a demand for transparent ink receptive imageable receptors that are used as overlays in technical drawings and as transparencies for overhead projection. Imaging with either the ink jet printer or the pen plotter involves depositing ink on the surface of these transparent receptors. These imaging devices conventionally utilize inks that can remain exposed to air for long periods of time without drying.

Since it is desirable that the surface of these receptors be dry and non-tacky to the touch, even after absorption of significant amounts of liquid soon after imaging, transparent materials that are capable of absorbing significant amounts of liquid while maintaining some degree of durability and transparency, are useful as imageable receptors for imaging.

Liquid-absorbent materials disclosed in U.S. Pat. Nos. 5,134,198, 5,192,617, 5,219,928 and 5,241,006 attempt to improve drying and decrease dry time. These materials comprise crosslinked polymeric compositions capable of forming continuous matrices for liquid absorbent semi-interpenetrating polymer networks. These networks are blends of polymers wherein at least one of the polymeric components is crosslinked after blending to form a continuous network throughout the bulk of the material, and through which the uncrosslinked polymeric components are intertwined in such a way as to form a macroscopically homogeneous composition. Such compositions are useful for forming durable ink absorbent, transparent graphical materials.

WO 8806532 (AM International) discloses a recording transparency and an aqueous method of preparation. The transparency is coated with a hydroxyethylcellulose polymer or mixture of polymers. The coating solution may also contain a surfactant to promote leveling and adhesion to the surface, and hydrated alumina in order to impart pencil tooth to the surface.

U.S. Pat. No. 5,120,601 (Asahi) discloses a recording sheet comprising an ink receiving layer containing highly water absorptive 1 to 100 μm resin particles and a binder. The resin particles protrude to a height of not less than 1 μm from the surface of the binder layer and comprise from 50 to 5,000 per 1 $mm^2$ surface. The resin particles include sodium, lithium and potassium polyacrylates; vinyl alcohol/acrylamide copolymer; sodium acrylate/acrylamide copolymer; cellulose polymers; starch polymers; isobutylene/maleic anhydride copolymer; vinyl alcohol/acrylic acid copolymer; polyethylene oxide modified products; dimethyl ammonium polydiallylate; and quaternary ammonium polyacrylate. Useful binders can be any hydrophilic resin, e.g., starch, gelatin, celluloses, polyethyleneimine, polyacrylamide, polyvinylpyrrolidones polyvinyl alcohols, polyester, sodium polyacrylate, polyethylene oxide, poly-2-hydroxyethylmethacrylate, crosslinked hydrophilic polymers, hydrophilic water soluble polymer complexes, and the like U.S. Pat. No. 4,636,805 (Canon) discloses a recording medium comprising an ink receiving layer capable of fixing an ink within 3 minutes at 20° C. and 65% RH at a proportion of 0.7 $\mu l/cm^2$. One embodiment contains hydroxyethyl cellulose. Other materials are disclosed such as various gelatins; polyvinyl alcohols; starches; cellulose derivatives; polyvinylpyrrolidone, polyethyleneimine; polyvinylpyridium halide, sodium polyacrylate, SBR and NBR latexes; polyvinylformal; PMMA; polyvinylbutyral; polyacrylonitrile; polyvinylchloride; polyvinylacetate; phenolic resins and so on.

U.S. Pat. No. 4,701,837 (Canon) discloses a light transmissive recording medium having an ink receiving layer formed mainly of a water soluble polymer and a crosslinking agent. The crosslinked polymer has a crosslinking degree satisfying the water resistance of the receiving layer while giving the layer the ink receiving capacity of 0.2 $\mu l/cm^2$. The water soluble polymer may include natural polymers or modified products thereof such as gelatin, casein, starch, gum arabic, sodium alginate, hydroxyethyl cellulose, carboxyethyl cellulose and the like; polyvinyl alcohols; complete or partially saponified products of vinylacetate and other monomers; homopolymers or copolymers with other monomers of unsaturated carboxylic acids such as (meth) acrylic acid, maleic acid, crotonic acid and the like; copolymers or homopolymers with other vinyl monomers of sulfonated vinyl monomers such as vinylsulfonic acid, sulfonated styrene and the like; copolymers or homopolymers with other vinyl monomers of (meth)acrylamide; copolymers or homopolymers with other vinyl monomers of ethylene oxide; terminated polyurethanes having blocked isocyanate groups; polyamides having such groups as mentioned above; polyethyleneimine; polyurethane; polyester; and so on.

U.S. Pat. No. 5,277,965 (Xerox) discloses a recording medium comprising a base sheet with an ink receiving layer on one surface, and a heat absorbing layer on the other, and an anti-curl layer coated on the surface of the heat absorbing layer. The materials suitable for the ink receptive layer can include hydrophilic materials such as binary blends of polyethylene oxide with one of the following group: hydroxypropyl methyl cellulose (Methocel), hydroxyethyl cellulose; water-soluble ethylhydroxyethyl cellulose, hydroxybutylmethyl cellulose, hydroxypropyl cellulose, methyl cellulose, hydroxyethylmethyl cellulose; vinylmethyl ether/maleic acid copolymers; acrylamide/acrylic acid copolymers; salts of carboxymethylhydroxyethyl cellulose; cellulose acetate; cellulose acetate hydrogen phthalate, hydroxypropyl methyl cellulose phthalate; cellulose sulfate; PVA; PVP; vinyl alcohol/vinylacetate copolymer and so on.

U.S. Pat. No. 5,118,570 (Xerox) discloses a transparency comprising a hydrophilic coating and a plasticizer. The plasticizer can be selected from the group consisting of anhydrides, glycerols, glycols, substituted glycerols, pyrrolidinones, alkylene carbonates, sulfolanes, and stearic acid derivatives. In one specific embodiment directed to a humidity resistant ink jet transparency, the coating comprised of a ternary mixture of hydroxypropyl cellulose, carboxymethyl cellulose, polyethylene oxide and a plasticizer. This coating can also have dispersed therein additives such as colloidal silica. Another specific is a blend comprised of polyethylene oxide and carboxymethyl cellulose together with a component selected from the group consisting of (1) hydroxypropyl cellulose; (2) vinylmethyl ether/maleic acid copolymer; (3) carboxymethyl hydroxypropyl cellulose; (4) hydroxyethyl cellulose; (5) acrylamide/acrylic acid copolymer; (6) cellulose sulfate; (7) poly(2-acrylamido-2-methylpropane)

sulfonic acid; (8) poly(vinyl alcohol); (9) poly(vinyl pyrrolidone); and (10) hydroxypropyl methyl cellulose.

U.S. Pat. No. 5,068,140 (Xerox) discloses a transparency comprised of a supporting substrate and an anticurl coating or coatings thereunder. In one specific embodiment, the transparency comprises of an anticurl coating comprising two layers. The ink receiving layer in one embodiment is comprised of blends of poly(ethylene oxide), mixtures of poly(ethylene oxide) with cellulose such as sodium carboxymethyl cellulose, hydroxyalkylmethyl cellulose and a component selected from the group consisting of (1) vinylmethyl ether/maleic acid copolymer; (2) hydroxypropyl cellulose; (3) acrylamide/acrylic acid copolymer, (4) sodium carboxymethylhydroxyethyl cellulose; (5) hydroxyethyl cellulose; (6) water soluble ethylhydroxyethyl cellulose; (7) cellulose sulfate; (8) poly(vinyl alcohol); (9) polyvinyl pyrrolidone; (10) poly(acrylamido 2-methyl propane sulfonic acid); (11) poly(diethylenetriamine-co-adipic acid); (12) poly(imidazoline) quaternized; (13) poly(N, N-methyl-3-S dimethylene piperidinum chloride; (14) poly(ethylene imine) epichlorohydrin modified; (15) poly(ethylene imine) ethoxylated blends of poly(a-methylstyrene) with a component having a chlorinated compound.

As previously disclosed, generation of an image by an ink jet printer results in large quantities of solvent, generally blends of glycols and water, which remain in the imaged areas. Hence ink-receptive coatings are coated over substrates to absorb the solvent quickly to form good images. Many of the materials disclosed above already address this effect, which is magnified with transparency materials. However, diffusion of this solvent into unimaged areas can result in "bleeding" of the image, when the dye is carried along with the solvent.

U.S. Pat. No. 5,342,688 addresses this bleeding problem. It discloses an improved ink-receptive sheet comprising a transparent substrate bearing on at least one major surface thereof an ink-receptive layer which comprises at least one imaging polymer and an effective amount of polymeric mordant comprising a guanidine functionality.

With the advent of pigmented inks, other problems are encountered when these same prior art materials are used as ink-receptive coatings. One of the problems can be characterized as 'mud-cracking'. The pigment, along with other ink components, e.g., polymeric dispersants, are believed to form a layer on the surface of the ink receptor. The degree of admixture with receptive layer components varies with the specific components and pigments used. Upon drying, this layer can literally fracture, and results in poor image quality and low densities. This effect is quite apparent with some printers already on the market, for example, HP Deskjet 1200C and becomes much more severe with others. Therefore, other properties need to be incorporated into the coatings to improve image quality. The inventors have now discovered an ink-receptive sheet useful for projecting an image, commonly called a "transparency" which, when imaged with an ink depositing device can be successfully printed with pigmented typed-inks with good image quality. Embodiments of this invention also have reduced image bleeding, improved shelf life, even when it is exposed to elevated temperature and high humidity, or in cases where solvent is prevented from leaving the coating, e.g., when stored in a transparency protector, and also display excellent drytimes.

SUMMARY OF THE INVENTION

Improved ink-receptive sheets of the invention comprise a substrate bearing on at least one major surface an ink-receptive coating. This coating is comprised of an image receptive polymer, and an admixture of additives which work together to provide a coating which will, when imaged, provide a high-quality, fast-drying image. Image-receptive sheets comprising this two layer coating system produce images with little or no problem areas caused by bleed or mud-cracking. Preferred embodiments contain additives which assist feedability, clarity, and the like.

Ink-receptive coatings of the invention comprise at least two layers, a thin upper layer and a thick base layer, wherein the upper layer comprises a relatively high molecular weight binder selected from the group consisting of methylcellulose, hydroxypropyl methylcellulose, and blends thereof.

Incorporation of the high molecular weight cellulose binder into the upper layer of the two layer coating improves the image quality of an ink-receptive coating by eliminating mud-cracking and bleeding tendencies. Ink-receptive sheets comprising this two layer coating system exhibit fast dry time and good image quality with aqueous inks including pigmented-type inks.

In one preferred embodiment, the upper layer also comprises at least one organic acid salt of polyethyleneimine or a substituted polyethyleneimine, and the base layer comprises an absorbent resin or blends thereof.

A highly preferred embodiment of the present invention comprises a transparent substrate and a two-layer ink-receptive coating, said coating comprising an upper layer and a base layer, said upper layer comprising:

a) from about 20 parts to about 100 parts by weight of a binder selected from the group consisting of methylcellulose, hydroxypropylcellulose and blends thereof; and b) from 0 parts to about 50 parts by weight of an organic acid salt selected from the group consisting of polyethyleneimine salts and substituted polyethyleneimine salts;

and said base layer comprising a blend of polyethylene-acrylic acid copolymer and polyvinylpyrrolidone.

When shelf life elimination of bleeding is critical, as in humid conditions, a mordant can also be present, in the upper layer, base layer or both layers. When a mordant is used, it is typically present in an amount of from about 1% to about 20%.

The upper layer preferably has a thickness of from about 0.5 μm to about 10 μm, and the thickness of the base layer preferably ranges from about 10 μm to about 40 μm.

As used herein, these terms have the following meanings.

1. The term "mud-cracking" means a physical cracking of the image resulting in lower density and quality. The cracks are so called because they resemble the cracking visible in the mud of a dried river bed.
2. The terms "hydrophilic" and "hydrophilic surface" are used to describe a material that is generally receptive to water, either in the sense that its surface is wettable by water or in the sense that the bulk of the material is able to absorb significant quantities of water. Materials that exhibit surface wettability by water have hydrophilic surfaces.
3. The term "hydrophilic liquid-absorbing materials" means materials that are capable of absorbing significant quantities of water, aqueous solutions, including those materials that are water-soluble. Monomeric units will be referred to as hydrophilic units if they have a water-sorption capacity of at least one mole of water per mole of monomeric unit.

4. The terms "hydrophobic" and "hydrophobic surface" refer to materials which have surfaces not readily wettable by water. Monomeric units will be referred to as hydrophobic if they form water-insoluble polymers capable of absorbing only small amounts of water when polymerized by themselves.
5. The term "mordant" means a compound which, when present in a composition, interacts with a dye to prevent diffusion through the composition.
6. The term "pigment layer" means that layer generated on the surface of the transparency comprised of the pigment, polymeric dispersants, and various components from the receptor layer.

Unless otherwise specifically stated, all amounts, percents, ratios, and parts herein are by weight.

DETAILED DESCRIPTION OF THE INVENTION

In ink jet printing, the use of pigmented inks can generate very light-fast, nonbleeding, and potentially very dense images. However, on transparency films, density may be diminished. When imaging on such a medium, pigmented inks appear to generate a layer on the surface of the transparency. This pigment layer is comprised not only of the pigment, but also polymeric dispersants and the like present in the ink, and various components from the receptor layer, which may be solubilized by the ink. If this layer is not sufficiently elastic, stresses generated upon drying and possible shrinking may result in the cracking of this pigment layer, which is called mud-cracking.

To be effective in preventing mud-cracking with most pigmented-type inks, the ink-receptive coating of the present invention comprises at least two layers; a thin upper layer, and a thicker base layer. The upper layer preferably has a thickness of from about 0.5 μm to about 10 μm, and the thickness of the base layer preferably ranges from about 10 μm to about 40 μm. The thin upper layer comprises a high viscosity modified cellulose binder, i.e., from about 250 cps to about 15000 cps or higher. The use of this cellulose binder substantially eliminates the mud-cracking tendencies of such layers. Useful cellulose binders include methylcellulose, hydroxypropylmethyl cellulose, hydroxyethylmethyl cellulose, and the like, with methylcellulose and hydroxypropylmethyl cellulose being preferred.

Cellulose derivatives that are unsuitable as binders include hydroxyethyl cellulose, hydroxymethyl cellulose, and carboxymethyl cellulose, although these may be used as additives when they comprise less than about 40% of the overall cellulose content.

Cellulose derivatives that are unsuitable as binders due to their hydrophobic nature, water insolubility, need for organic solvents, and tendency to cause coalescence of pigmented as well as colored ink jet inks include ethylcellulose, ethylhydroxyethyl cellulose and hydroxybutyl cellulose. These may be used as additives using appropriate solvent blends when they comprise less than about 40% of the overall cellulose content. Hydroxypropyl cellulose, although water soluble, is less suitable as a binder for the same reasons as the latter materials, although it may also be used as an additive when it comprises less than 40% of the overall cellulose content.

The balance of properties in a imageable coating is very important. Other properties cannot be sacrificed to improve a single problem. In a preferred embodiment, the thin upper layer further comprises organic acid salts of polyethyleneimine for optimization of other properties such as drytime, smudging of the images, image brightness, color quality, tack and bleeding. Useful acids include dicarboxylic acid derivatives, containing from about 2 to about 14 carbon atoms, with phthalic acids, boric acid, and substituted sulfonic acids, such as methanesulfonic acid, with p-toluenesulfonic acid being preferred.

Larger amounts of other additives can also be present in the upper layer, provided they do not serve to decrease the integrity or elasticity of the pigment layer. These additives include water soluble polymers such as poly-acrylic acid, polyvinylpyrrolidone, GAF Copolymer 845, polyethylene oxide, water soluble starches, e.g. Staylok® 500 and water soluble clays, e.g. Laponite RDAs as long as these additives comprise less than about 40% of the topcoat solids. Colloidal silica, boric acid, and surfactants may also be included.

The base layer of the coating system functions as the ink-receptive layer and must be able to absorb the relatively large quantities of ink discharged by the printer. The base layer of the coating can comprise any water-absorbent materials, including e.g., polyacrylamides, polyvinylpyrrolidone and modified polyvinylpyrrolidones, polyvinyl alcohol and modified polyvinyl alcohols, and other hydrophilic and liquid absorptive copolymerizable monomers. Specific examples include:

a) nitrogen-containing hydrophilic, and water absorptive monomers selected from the group consisting of vinyl lactams such as N-vinyl-2-pyrrolidone; acrylamide, methacrylamide and their N-monoalkyl and N,N-dialkyl derivatives thereof; alkyltertiaryamino (meth-)alkylacrylates; vinylpyridines such as 2-vinyl and 4-vinyl pyridines; preferably N-vinyl-2-pyrrolidone; acrylamide, methacrylamide and their N-monoalkyl and N,N-dialkyl derivatives thereof; and b) hydrophilic monomers selected from the group consisting of hydroxyalkyl acrylate and methacrylate, the alkyl group having from about 1 to 5 carbon atoms, preferably from 1 to 2 carbon atoms, and more preferably hydroxyethyl acrylate and methacrylate; alkoxyalkyl acrylate and methacrylate, the alkyl group preferably ranging from 1 to 5 carbon atoms, preferably from 1 to 2 carbon atoms.

The base layer can also comprise a crosslinked semi-interpenetrating network, or "SIPN", formed from polymer blends comprising a) at least one crosslinkable polymeric component, b) at least one liquid-absorbent polymer comprising a water-absorbent polymer, and (c) optionally, a crosslinking agent. The SIPNs are continuous networks wherein the crosslinked polymer forms a continuous matrix, as disclosed in U.S. Pat. Nos. 5,389,723, 5,241,006, 5,376,727, and 5,208,092, incorporated herein by reference.

Preferred materials for the base layer include polyvinylpyrrolidone and polyethylene-acrylic acids having at least 10% by weight acrylic acid content. A base layer comprising a blend of polyvinylpyrrolidone (PVP/K-90) and a polyethylene-acrylic acid copolymer having 20% acrylic acid content, Primacor® 5980, used with the preferred upper layer yields ink-receptive sheets exhibiting excellent dry times when used in virtually any ink jet printer.

As noted above, for humid conditions, and where maximum bleed control is critical, a mordant can also be present in either or both layers. If the mordant is present in a single layer, either the top layer or base layer, it comprises from about 1 part to about 20 parts of the solids, preferably from about 3 parts to about 10 parts.

Useful mordants include polymeric mordants having at least one guanidine functionality having the following general structure:

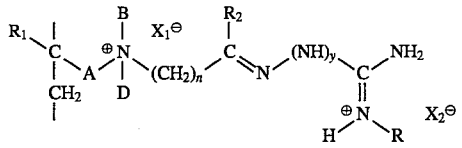

wherein A is selected from the group consisting of a COO-alkylene group having from about 1 to about 5 carbon atoms, a CONH-alkylene group having from about 1 to about 5 carbon atoms, $COO(CH_2CH_2O)_nCH_2$— and $CONH(CH_2CH_2O)_nCH_2$—, wherein n is from about 1 to about 5;

B and D are separately selected from the group consisting of alkyl group having from about 1 to about 5 carbon atoms;

or A, B, D and N are combined to form a heterocyclic compound selected from the group consisting of:

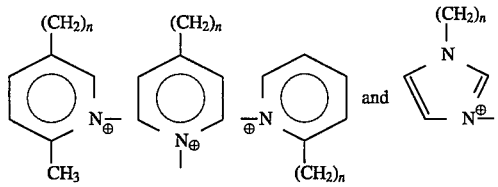

$R_1$ and $R_2$ are independently selected from the group consisting of hydrogen, phenyl, and an alkyl group containing from about 1 to about 5 carbon atoms;

R is selected from the group consisting of hydrogen, phenyl, benzimidazolyl, and an alkyl group containing from about 1 to about 5 carbon atoms, Y is selected from the group consisting of 0 and 1, and $X_1$ and $X_2$ are anions.

A plasticizing compound may also be added to the base layer to control curling of the film. Compounds can include polyethylene glycols, polypropylene glycols, or polyethers; for example PEG 600 or Pycal 94. Lower molecular weight polyethylene glycols are more effective for reducing curl while maintaining a low level of haze. Accordingly, it is preferred that the polyethylene glycol have a molecular weight of less than 4000.

Feedability and antiblocking properties may also be controlled by the addition of a particulate, commonly called a bead, or microsphere. Suitable particulates include starches, glass beads, silicas and polymeric beads, with a preferred embodiment comprising polymethyl methacrylate (PMMA) beads. Levels of particulate are limited by the requirement that the final coating be transparent with a haze level of 15% or less, as measured according to ASTM D1003–61 (Reapproved 1979). The preferred mean particle diameter for particulate material is from about 5 to about 40 micrometers, with at least 25% of the particles having a diameter of 15 micrometers or more. Most preferably, at least about 50% of the particulate material has a diameter of from about 20 micrometers to about 40 micrometers. While the particulate may be added to either or both layers, preferred embodiments contain the particulate in the upper layer.

Other optional ingredients include such conventional adjuvants as catalysts, thickeners, adhesion promoters, glycols, defoamers, surfactants and the like.

The ink-receptive formulations can be prepared by dissolving the components in a common solvent. Well-known methods for selecting a common solvent make use of Hansen parameters, as described in U.S. Pat. No. 4,935,307, incorporated herein by reference.

The ink-receptive coating system, i.e., all layers, can be applied to the film backing by any conventional coating technique, e.g., deposition from a solution or dispersion of the resins in a solvent or aqueous medium, or blend thereof, by means of such processes as Meyer bar coating, knife coating, reverse roll coating, rotogravure coating, and the like.

Drying of the ink-receptive layer can be effected by conventional drying techniques, e.g., by heating in a hot air oven at a temperature appropriate for the specific film backing chosen. For example, a drying temperature of about 120° C. is suitable for a polyester film backing.

Film substrates may be formed from any polymer capable of forming a self-supporting sheet, and may be opaque or transparent, e.g., films of cellulose esters such as cellulose triacetate or diacetate, polystyrene, polyamides, vinyl chloride polymers and copolymers, polyolefin and polyallomer polymers and copolymers, polysulphones, polycarbonates, polyesters, and blends thereof. Suitable films may be produced from polyesters obtained by condensing one or more dicarboxylic acids or their lower alkyl diesters in which the alkyl group contains up to about 6 carbon atoms, e.g., terephthalic acid, isophthalic, phthalic, 2,5-,2,6-, and 2,7-naphthalene dicarboxylic acid, succinic acid, sebacic acid, adipic acid, azelaic acid, with one or more glycols such as ethylene glycol, 1,3-propanediol, 1,4-butanediol, and the like.

Preferred film substrates or backings are cellulose triacetate or cellulose diacetate, poly(ethylene naphthalate), polyesters, especially poly(ethylene terephthalate), and polystyrene films. Poly(ethylene terephthalate) is most preferred. It is preferred that film backings have a caliper ranging from about 50 μm to about 200 μm. Film backings having a caliper of less than about 50 μm are difficult to handle using conventional methods for graphic materials. Film backings having calipers over 200 μm are stiffer, and present feeding difficulties in certain commercially available ink jet printers and pen plotters.

When polyester film substrates are used, they can be biaxially oriented to impart molecular orientation, and may also be heat set for dimensional stability during fusion of the image to the support. These films may be produced by any conventional extrusion method.

To promote adhesion of the ink-receptive layer to the film backing, it may be desirable to treat the surface of the film backing with one or more primers, in single or multiple layers. Useful primers include those known to have a swelling effect on the film backing polymer. Examples include halogenated phenols dissolved in organic solvents. Alternatively, the surface of the film backing may be modified by treatment such as corona treatment or plasma treatment.

Image-receptive sheets of the invention are particularly useful in the production of imaged transparencies for viewing in a transmission mode or a reflective mode, i.e., in association with an overhead projector.

The following examples are for illustrative purposes, and do not limit the scope of the invention, which is that defined by the claims.

Test Methods

Image Density

The transmissive image density is measured using Macbeth TD 903 densitometer with the gold and status A filters.

Mud-Cracking

A solid fill rectangular image, having a width the same as the cartridge and a length of about 10 to about 15 cm (4 to 6 inches) is visually examined and areas of low density rated as follows:

| Condition | Rating |
|---|---|
| Large numerous cracks | 0 |
| Medium visible cracks | 1 |
| Fine Cracks viewed using an eye loupe | 2 |
| Fine low-frequency cracks using an eye loupe | 3 |
| Edge cracking only or fine infrequent cracks using eye loupe | 4 |
| No cracks noted | 5 |

Dry Time

The environmental conditions for this test are 70° C. and 50% relative humidity (RH). The print pattern consists of solid fill columns of adjacent colors. The columns are ¼" to ½' wide, and 6–9 inches long. After printing the material is placed on a flat surface, then placed in contact with bond paper. A 2 kg rubber roller 2.5" wide is then twice rolled over the paper. The paper is then removed, and the dry time, $D_T$ is calculated by using the following formula:

$$D_T = T_D + (L_T/L_P)T_P$$

where $T_D$ is the length of time between the end of the printing and placing the image in contact with the bond paper. $L_T$ is the length of image transfer to paper; $L_P$ is the length of the printed columns, and $T_P$ is the time of printing.

EXAMPLE 1

This example was prepared as follows:

The base layer of the coating was prepared by mixing 9 g of a 10% aqueous solution of polyvinylpyrrolidone (available as PVPK®-90, from ISP), 9 g of a 10% aqueous solution of polyvinyl-alcohol (available as Airvol® 540 from Air Products), and 2 g of a 10% aqueous solution of P-134, a mordant having the following structure:

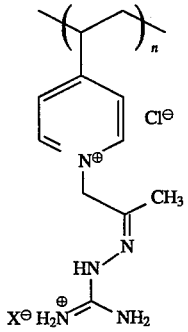

wherein the anion, $X^-$, is $Cl^-$.

After mixing of the polymers, the base layer was coated onto a 100 μm thick polyvinylidine chloride (PVDC) primed polyethylene terephthalate (PET) film at 200 μm wet thickness and then dried at 136° C. for 2 minutes.

A solution for a top coat was then prepared from 15 g of a 1% 1:1 water/ethanol solution of methylcellulose (available as Methocel® K 15M from Dow Chemical), and 0.6 g of a 10% aqueous solution of silica (available as Syloid™ 620 from W. R. Grace). This formulation was coated on top of the dried film from 1) at 150 μm wet thickness, and dried again at 136° C. for 2 minutes.

The ink-receptive sheet was then printed on an HP DeskJet® 1200C printer, using an experimental pigmented black ink similar to the commercially available one supplied with the 1200C, but having a different solvent. The image density was measured as described above, and the optical densities are shown in Table 1.

EXAMPLE 1C

This sample is taken from a box of commercially available HP51636F ink jet film, recommended by HP for Deskjet® 1200C printer. This formulation was also printed in the same manner as Example 1 and the result is also shown in Table 1. This showed cracks and therefore an overall lower optical density.

EXAMPLE 2

This example was prepared as follows:

1) A base layer solution was prepared containing 18.5 g of a 10% aqueous solution of Airvole® 540, and 1.5 g of a 10% aqueous solution of P-134 mordant. After mixing, it was coated onto a 100 μm thick polyvinylidine chloride (PVDC) primed polyethylene terephthalate (PET) film at 200 μm wet thickness and then dried at 110° C. for 2.5 minutes.
2) A solution for a top coat was then prepared from 15 g of a 1.25% 1:1 water/ethanol solution of Methocel® K 15M, 0.1 g of a 10% aqueous solution of Syloid® 620, and 0.05 g of a 10% aqueous solution of "FC-430" (available from 3M). This formulation was coated on top of the dried base layer at 150 μm wet thickness, and dried again at 110° C. for 2 minutes.

The resultant ink-receptive sheet was then printed on an HP DeskJet® 1200C printer using the commercially available black ink, and the black density was measured as described above. A uniform black image was obtained with no mud-cracking. The result is shown in Table 1.

EXAMPLE 2C

The ink-receptive sheet used for this example was the same commercially available ink jet film as 1-C, however it was imaged as described in Example 2. The result is also shown in Table 1. This ink-receptive sheet exhibited mud-cracking.xxx

TABLE 1

| Example | 1 | 1C | 2 | 2C |
|---|---|---|---|---|
| Density | 2.77 | 1.47 | 3.32 | 1.25 |

EXAMPLES 3–4

These ink-receptive sheets were prepared in the same manner as Example 1, except with the differing coating compositions shown below in Table 2. All are aqueous solutions, except the Methocel®, which is a water: methanol mixture having a 9:1 ratio; the PEI/Boric Acid is water 1:9, and buffered with boric acid to obtain a pH of 8.2. All solutions are 10% solids, except for the Methocel® which is 1%.

TABLE 2

| | Base Layer | | | | Top layer | | |
|---|---|---|---|---|---|---|---|
| | | | | | PEI/ | | |
| Ex. | Airvol 540(g) | PVP K90(g) | PEG 600(g) | P134 (g) | Methocel A4M(g) | Boric acid(g) | Loksiz 30(g) |
| 3 | 17 | 2 | 1 | 1 | 10 | 0.53 | .03 |
| 4 | 17 | 2 | 1 | 1 | 10 | 0 | 0.03 |

These ink-receptive sheets were tested using a 300DPI HP Printer, a printer similar to Deskjet® 1200C, but using larger amounts of ink having a higher solvent content. The dry time results are shown in Table 3.

TABLE 3

| Examples/Color | 3 Dry Time (min.) | 4 Dry Time (min.) |
|---|---|---|
| Magenta | <5 | >13 |
| Blue | 5 | >13 |
| Green | 5 | >13 |
| Red | >13 | >13 |

EXAMPLES 5–6

This Example demonstrates the effect of replacing the upper coat with a blend of PVP and a copolymer of ethylene and acrylic acid. Two films were made, both using a Primacor® solution made of 10 g of 20% Primacot®5990 (Water/$NH_4OH$); 20 g of 10% PVP/K-90, and 2 g of Pycal® 94, a polyvinyl ether plasticizer as the base layer, coated at 1 g/ft$^2$ and dried at 135° C. for 2.5 minutes. Example 5 used the same PEI-Boric Acid solution from Example 3, and Example 6 used the same control topcoat from Example 4.

TABLE 4

| Examples/Color | 5 Dry Time (min.) | 6 Dry Time (min.) |
|---|---|---|
| Magenta | <4 | <4 |
| Blue | <4 | 7 |
| Green | <4 | 7 |
| Red | 5 | 7 |

EXAMPLES 7 and 8C

These samples were made to demonstrate the effect on mud-cracking of using boric acid in the upper layer, and polyvinylalcohol was present in the base layer.

The formulation for the base layer for both Examples was the same as that in Examples 5–6. The upper layer formulation for Example 7 was made from the following formulation:

10 g of 1.25% aqueous solution of Methocel® K15M; 0.5 g of a 10% solution made by adding N-(2hydroxyethyl)ethylenediamine triacetic acid (available from Aldrich Chemical) to a 10% solution of "Waterfree PEI" available from BASF PEI until a pH of 8.1 was obtained;

0.3 g of a 5% solution of Boric acid in isopropanol, and 0.3 g of a 10% aqueous solution of LokSiz® 30 starch particles. The upper layer formulation for Example 8C was made with 0.3 g of isopropanol replacing the Boric acid of Example 7. Example 8C showed mud-cracking; Example 7 showed no mud-cracking.

EXAMPLES 9–10

These examples demonstrate the effect on image haze of using PEI/PTSA salts in the upper layer.

The formulation for the base layer for both examples is the same as for that in Examples 5–6. The upper layer formulation for Example 9 is the following:

20 g of a 1% aqueous solution of Methocel® A4M 0.8 g of a 5% boric acid solution 0.2 g of Ludox® LS 0.6 g of a 10% aqueous solution of LokSiz® 30 starch particles.

The upper layer for Example 10 is the same as Example 9, except that 0.4 g of a 28% aqueous solution of PEI/PTSA salt having a ratio of 1/1.8 is added.

These ink-receptive sheets were imaged on a 300 DPI Hewlett-Packard printer and the image haze in the cyan region was measured on the Gardner Hazeguard® System XL-211. Example 10, containing the PEI/PTSA sales, yields an image with colors ranked "vivid" when projected, and has an image haze of 9%. Example 9, which does not contain the PEI/PTSA salt yields colors ranked "dull" and has an image haze of 28%.

EXAMPLES 11–15

These examples were made to show the effect on dry time of replacing PTSA with HCl. The base layer had the same composition as in Examples 5–6. The top layer formulation for Example 11 is shown below:

10 g of 1 10% aqueous solution of Methocel®4M;

0.3 g of a 10% aqueous solution of Lok-Size®;

0.2 g of a 32% aqueous solution of Ludox® LS;

0.4 g of a 30% aqueous solution of PEI/Boric acid; and 0.4 g of a 28% aqueous solution of PEI/PTSA in the ratio of 1:1.8.

The top layer compositions for these examples were made by replacing PTSA with HCl on a molar basis, in increments of 25%, respectively. These ink-receptive sheets were tested for dry time, and the results are shown in Table 5.

TABLE 5

| Example | PTSA % | Black Dry Time (min.) |
|---|---|---|
| 11 | 100 | 7.9 |
| 12 | 75 | 8.2 |
| 13 | 50 | 8.5 |
| 14 | 25 | 8.4 |
| 15 | 0 | >8.5 |

Dry times of greater than 8.5 would be less preferred than dry times of less than 8.5, though the samples would still be acceptable. These ink-receptive sheets demonstrate that the choice of acid has an effect on dry time.

EXAMPLES 16–23

These samples were made to demonstrate the dry time using a variety of PEI salts. The base layer composition was the same as that of Example 3–4, while the upper layer compositions for these examples all contained:

15 g of a 1% aqueous solution of Methocel® A4M 0.45 g of a 10% aqueous solution of Lok-Size® 30 and the following as shown in Table 6.

TABLE 6

| Example | Ingredient |
|---|---|
| 16 | water |
| 17 | 1 g Waterfree PEI, and 1.09 g 1,10 decanedicarboxylic acid |
| 18 | 1 g Waterfree PEI, 0.96 g sebacic acid |
| 19 | 1 g Waterfree PEI, 0.82 g suberic acid |
| 20 | 1 g Waterfree PEI, 0.69 g adipic acid |
| 21 | 1 g Waterfree PEI, 2.0 g boric acid |
| 22 | 1 g W-aterfree PEI, 0.9 g PTSA plus 0.15 g adipic acid |
| 23 | 1 g Waterfree PEI, 0.89 g PTSA and 0.48 g Sebacic acid |

These samples were coated at 75 mm wet thickness over the base and dried for 1.5 min. at 120° C. and printed. The dry times are shown in Table 7.

TABLE 7

| | Dry Time (min.) | | |
|---|---|---|---|
| Examples | Blue | Green | Red |
| 16 | 8.0 | 7.5 | 8.0 |
| 17 | 6.5 | 5.0 | 6.5 |
| 18 | 4.5 | 3.5 | 5.0 |
| 19 | 7.0 | 6.0 | 7.5 |
| 20 | 6.5 | 6.0 | 7.5 |
| 21 | 5.5 | 5.5 | 7.0 |
| 22 | 5.0 | 4.0 | 6.5 |
| 23 | 6.0 | 5.5 | 7.0 |

EXAMPLES 24–27 and 28C–29C

These samples were made to demonstrate the effect of the molecular weight of Methocel® on mud-cracking. The Methocel® molecular weight was described in terms of viscosity values in centipoise. The upper layer formulation contained:

12.5g of 11% aqueous solution of Methocel®;

0.1 g of a 10% aqueous solution of ED3A/PEI;

0.3 g of a 10% aqueous solution of Lok-Size®;

0.2 g of a 10% aqueous solution of PEI/Boric acid; and 0.2 g of a 10% aqueous solution of PEI/PTSA in the ratio of 1:1.8.

The various Methocels used are listed in Table 8 along with the viscosities. These formulations were coated at 75 mm wet thickness over a base layer having the same composition as that of Examples 5–6, and dried at 220° C. for 2 minutes. These ink-receptive sheets were tested for mud-cracking and the results are also shown in Table 8.

TABLE 8

| Example | Methocel | Viscosity of 2% aqueous solution (cps) | Mud Cracking |
|---|---|---|---|
| 24 | A4C | 400 | 5 |
| 25 | A4M | 4000 | 5 |
| 26 | J5MS | 5000 | 5 |
| 27 | K15M | 15000 | 5 |
| 28C | E3 | 3 | 0 |
| 29C | F50 | 50 | 0.5 |

What is claimed is:

1. An ink-receptive sheet comprising a substrate bearing on at least one major surface an ink-receptive coating comprising at least two layers, an upper layer and a base layer, said upper layer being thinner than said base layer, wherein said upper layer comprises a high viscosity binder selected from the group consisting of methylcellulose, hydroxypropyl methylcellulose, and blends thereof, said binder having a viscosity of at least about 250 cps, wherein said upper layer also comprises at least one organic acid salt of polyethyleneimine.

2. A two-layer ink-receptive sheet according to claim 1 further comprising from about 1 to about 20 parts of a mordant in said upper layer or said base layer.

3. An ink-receptive sheet according to claim 1 wherein said upper layer has a thickness of from about 0.5 μm to about 10 μm, and said base layer has a thickness of from about 10 μm to about 40 μm.

4. An ink-receptive sheet according to claim 1 wherein said base layer comprises an uncrosslinked water-absorbent material.

5. An ink-receptive sheet according to claim 4 wherein said base layer comprises a water-absorbent material selected from the group consisting of polyacrylamides, polyvinylpyrrolidone, modified polyvinylpyrrolidones, polyethylene-acrylic acid copolymers, polyvinyl alcohol, and modified polyvinyl alcohols.

6. An ink-receptive sheet according to claim 5 wherein said base layer is selected from the group consisting of polyvinylpyrrolidone and polyethyleneacrylic acids having at least 10% by weight acrylic acid content.

7. An ink-receptive sheet according to claim 6 wherein said base layer comprises a blend of polyvinylpyrrolidone and a polyethylene-acrylic acid copolymer having 20% acrylic acid content.

8. An ink-receptive sheet according to claim 1 wherein said base layer comprises a crosslinked semi-interpenetrating network.

9. An ink-receptive sheet according to claim 1 wherein said upper layer further comprises particulates selected from the group consisting of starch, glass beads, polymeric beads, and silica particles.

10. An ink-receptive sheet according to claim 9 wherein said particulates are polymeric beads formed from a polymer selected from the group consisting of poly(methylmethacrylate), poly(stearyl methacrylate)hexanedioldiacrylate copolymers, poly(tetrafluoroethylene), and polyethylene.

11. An ink-receptive sheet according to claim 10 wherein said polymeric beads are formed from poly(methylmethacrylate).

12. An ink-receptive sheet according to claim 1 wherein said substrate is opaque.

13. An ink-receptive sheet according to claim 1 wherein said substrate is transparent.

14. A two-layer ink-receptive sheet according to claim 1 wherein said base layer comprises a blend of polyethylene-acrylic acid copolymer and polyvinylpyrrolidone.

* * * * *